US010607801B2

(12) United States Patent
Takahashi et al.

(10) Patent No.: US 10,607,801 B2
(45) Date of Patent: Mar. 31, 2020

(54) ELECTRIC FIELD RADIATION DEVICE AND REGENERATION PROCESSING METHOD

(71) Applicant: MEIDENSHA CORPORATION, Tokyo (JP)

(72) Inventors: Daizo Takahashi, Numazu (JP); Toshinori Tatsumi, Numazu (JP); Michihiro Hatanaka, San Jose, CA (US)

(73) Assignee: MEIDENSHA CORPORATION, Tokyo (JP)

( * ) Notice: Subject to any disclaimer, the term of this patent is extended or adjusted under 35 U.S.C. 154(b) by 0 days.

(21) Appl. No.: 16/309,238

(22) PCT Filed: Mar. 16, 2017

(86) PCT No.: PCT/JP2017/010549
§ 371 (c)(1),
(2) Date: Dec. 12, 2018

(87) PCT Pub. No.: WO2017/217051
PCT Pub. Date: Dec. 21, 2017

(65) Prior Publication Data

US 2019/0341218 A1 Nov. 7, 2019

(30) Foreign Application Priority Data

Jun. 13, 2016 (JP) ..... 2016-116954

(51) Int. Cl.
*H01J 35/06* (2006.01)
*H01J 35/12* (2006.01)
(Continued)

(52) U.S. Cl.
CPC ..... *H01J 35/065* (2013.01); *H01J 35/12* (2013.01); *H01J 35/16* (2013.01); *H05G 1/025* (2013.01); *H01J 2235/062* (2013.01)

(58) Field of Classification Search
CPC ..... H01J 35/065; H01J 35/16; H01J 35/12; H01J 2235/062; H01J 35/06; H05G 1/025; H05G 1/00; H05G 1/02
(Continued)

(56) References Cited

U.S. PATENT DOCUMENTS 3,303,372 A 2/1967 Gager
4,679,219 A 7/1987 Ozaki
(Continued)

FOREIGN PATENT DOCUMENTS

JP 54-93375 U1 7/1979
JP 61-062344 U 4/1986
(Continued)

OTHER PUBLICATIONS

Amendment and English translation, dated Feb. 17, 2017, 7 pages.
(Continued)

*Primary Examiner* — David P Porta
*Assistant Examiner* — Gisselle M Gutierrez
(74) *Attorney, Agent, or Firm* — Foley & Lardner LLP

(57) ABSTRACT

Emitter (3) and target (7) are arranged so as to face each other in vacuum chamber (1), and guard electrode (5) is provided at outer circumferential side of electron generating portion (31) of emitter (3). Guard electrode (5) is supported movably in directions of both ends of vacuum chamber (1) by guard electrode supporting unit (6). To perform regeneration process of guard electrode (5), guard electrode (5) is moved to opening (22) side (to separate position) by operating guard electrode supporting unit (6), and a state in which field emission of electron generating portion (31) is
(Continued)

suppressed is set, then by applying voltage across guard electrode (5), discharge is repeated. After performing regeneration process, by operating guard electrode supporting unit (6) again, guard electrode (5) is moved to opening (21) side (to emitter position), and a state in which field emission of electron generating portion (31) is possible is set.

11 Claims, 4 Drawing Sheets

(51) Int. Cl.
*H01J 35/16* (2006.01)
*H05G 1/02* (2006.01)

(58) Field of Classification Search
USPC ..... 378/122
See application file for complete search history.

(56) References Cited

U.S. PATENT DOCUMENTS

| | | | |
|---|---|---|---|
| 4,912,739 | A | 3/1990 | Weiss |
| 7,085,351 | B2 | 8/2006 | Lu et al. |
| 7,965,818 | B2 | 6/2011 | Jaafar et al. |
| 8,005,191 | B2 | 8/2011 | Jaafar et al. |
| 8,378,561 | B2 | 2/2013 | Ishiguro et al. |
| 8,761,344 | B2 | 6/2014 | Reynolds et al. |
| 8,913,719 | B2 | 12/2014 | Kuribayashi et al. |
| 10,068,741 | B2 | 9/2018 | Takahashi et al. |
| 2004/0028183 | A1 | 2/2004 | Lu et al. |
| 2006/0274889 | A1 | 12/2006 | Lu et al. |
| 2007/0046166 | A1 | 3/2007 | Okada et al. |
| 2010/0002840 | A1 | 1/2010 | Jaafar et al. |
| 2011/0115363 | A1 | 5/2011 | Ishiguro et al. |
| 2011/0142193 | A1 | 6/2011 | Frontera et al. |
| 2011/0305314 | A1 | 12/2011 | Kitamura et al. |
| 2012/0027177 | A1 | 2/2012 | Ogata et al. |
| 2012/0194057 | A1 | 8/2012 | Suzuki et al. |
| 2013/0259197 | A1 | 10/2013 | Kuribayashi et al. |
| 2019/0214215 | A1 | 7/2019 | Takahashi et al. |

FOREIGN PATENT DOCUMENTS

| | | | | | |
|---|---|---|---|---|---|
| JP | 03-156846 | A | | 7/1991 | |
| JP | 2005-346942 | A | | 12/2005 | |
| JP | 2008-150253 | A | | 7/2008 | |
| JP | 2008-166059 | A | | 7/2008 | |
| JP | 2008-311174 | A | | 12/2008 | |
| JP | 2010-056062 | A | | 3/2010 | |
| JP | 2010-186694 | A | | 8/2010 | |
| JP | 2011-8998 | A | | 1/2011 | |
| JP | 2011-119084 | A | | 6/2011 | |
| JP | 2011119084 | | * | 6/2011 | ..... G06F 21/20 |
| JP | 2011-258470 | A | | 12/2011 | |
| JP | 2012-049122 | A | | 3/2012 | |
| JP | 2013-225490 | A | | 10/2013 | |
| KR | 10-2016-0058582 | A | | 5/2016 | |
| WO | WO-03/080180 | A1 | | 10/2003 | |
| WO | WO-2010/013772 | A1 | | 2/2010 | |
| WO | WO-2016/104484 | A1 | | 6/2016 | |

OTHER PUBLICATIONS

Japanese Office Action and English translation, dated Dec. 20, 2016, 7 pages.
Korean Office Action, dated Aug. 7, 2017, 3 pages.
Notice of Allowance and English translation, dated Mar. 28, 2017, 4 pages.
Written Argument to Japanese Office Action and English translation, dated Feb. 17, 2017, 5 pages.
USPTO Office Action, U.S. Appl. No. 16/312,565, dated Aug. 21, 2019, 12 pages.
U.S. Appl. No. 16/311,985, filed Dec. 20, 2018, Meidensha Corporation.
U.S. Appl. No. 16/312,565, filed Dec. 21, 2018, Meidensha Corporation.
Japanese Office Action and English translation, dated May 15, 2017, 9 pages.
Japanese Office Action and English translation, dated May 16, 2017, 9 pages.
Korean Office Action and English translation, Application No. 10-2019-7001913, dated Feb. 25, 2019, 7 pages.
Korean Office Action and English translation, Application No. 10-2019-7000030, dated Feb. 15, 2019, 7 pages.
USPTO Notice of Allowance, U.S. Appl. No. 16/311,985, dated May 15, 2019, 12 pages.
USPTO Notice of Allowance U.S. Appl. No. 16/312,565, dated Jan. 8, 2020, 21 pages.

* cited by examiner

ELECTRIC FIELD RADIATION DEVICE AND REGENERATION PROCESSING METHOD

TECHNICAL FIELD

The present invention relates to an electric field radiation device and a regeneration processing method that are applied to various devices such as an X-ray apparatus, an electron tube and a lighting system.

BACKGROUND ART

As an example of the electric field radiation device applied to various devices such as the X-ray apparatus, the electron tube and the lighting system, there has been known a configuration in which voltage is applied between an emitter (an electron source formed of carbon etc.) and a target which are positioned (which are separated at a predetermined distance) while facing to each other in a vacuum chamber of a vacuum enclosure, an electron beam is emitted by field emission (by generation of electrons and emission of the electrons) of the emitter, and by colliding the emitted electron beam with the target, a desired function (for instance, in the case of the X-ray apparatus, a radioscopy resolution by external emission of X-ray) is obtained.

Further, suppression of dispersion of the electron beam emitted from the emitter, for instance, by employing a triode structure formed with a grid electrode interposed between the emitter and the target, and/or by shaping a surface of an electron generating portion (a portion that is positioned at an opposite side to the target and generates electrons) of the emitter into a curved surface, and/or by providing a guard electrode, which is at the same potential as the emitter, at a circumferential edge portion of the emitter, has been discussed (e.g. Patent Documents 1 and 2).

It is desirable that the electron beam be emitted by generating the electrons from only the electron generating portion of the emitter by the above application of voltage. However, if an undesired minute protrusion or dirt etc. exists in the vacuum chamber, an unintentional flashover phenomenon easily occurs, and a withstand voltage performance cannot be obtained, then a desired function may not be able to be obtained.

This is, for instance, a case where a portion at which a local electric field concentration easily occurs (e.g. a minute protrusion formed during working process) is formed at the guard electrode etc. (the target, the grid electrode and the guard electrode, hereinafter simply called the guard electrode etc., as necessary), a case where the guard electrode etc. adsorb gas component (e.g. a residual gas component in the vacuum enclosure) and a case where an element causing the electron to be easily generated is contained in materials applied to the guard electrode etc. In these cases, the electron generating portion is formed also at the guard electrode etc., and a quantity of generation of the electron becomes unstable, then the electron beam easily disperses. For instance, in the case of the X-ray apparatus, there is a risk that X-ray will be out of focus.

Therefore, as a method of suppressing the flashover phenomenon (as a method of stabilizing the quantity of generation of the electron), for instance, a method of performing a voltage discharge conditioning process (regeneration (reforming); hereinafter simply called a regeneration process, as necessary) that applies voltage (high voltage) across the guard electrode etc. (e.g. between the guard electrode and the grid electrode) and repeats discharge, has been studied.

CITATION LIST

Patent Document

Patent Document 1: Japanese Unexamined Patent Application Publication No. 2008-150253

Patent Document 2: Japanese Unexamined Patent Application Publication No. 2011-008998

SUMMARY OF THE INVENTION

However, when the voltage of the regeneration process is merely applied across the guard electrode etc., field emission (e.g. field emission before performing the regeneration process) of the emitter also easily occurs, then there is a risk that the guard electrode etc. will not properly undergo the regeneration process.

The present invention was made in view of the above technical problem. An object of the present invention is therefore to provide a technique that is capable of performing the regeneration process of the guard electrode etc. while suppressing the field emission of the emitter and contributing to an improvement in characteristics of the electric field radiation device.

The electric field radiation device and the regeneration processing method according to the present invention are those that can solve the above problem. As one aspect of the electric field radiation device, an electric field radiation device comprises: a vacuum enclosure formed by sealing both end sides of a tubular insulator and having a vacuum chamber at an inner wall side of the insulator; an emitter positioned at one end side of the vacuum chamber and having an electron generating portion that faces to the other end side of the vacuum chamber; a guard electrode provided at an outer circumferential side of the electron generating portion of the emitter; a target positioned at the other end side of the vacuum chamber and facing to the electron generating portion of the emitter; and a movable guard electrode supporting unit supporting the guard electrode movably in both end directions of the vacuum chamber, and the guard electrode supporting unit is configured to change a distance between the electron generating portion of the emitter and the guard electrode by movement of the guard electrode supporting unit.

The guard electrode supporting unit has guard electrode side bellows that can expand and contract in the both end directions of the vacuum chamber, and either one end side or the other end side of the guard electrode side bellows retains the guard electrode supporting unit and the other is retained by the vacuum enclosure, and the guard electrode side bellows form a part of the vacuum enclosure.

The guard electrode supporting unit has a shaft portion that extends from the guard electrode to the one end side of the vacuum chamber, one end side of the shaft portion penetrates the vacuum enclosure and extends outside the vacuum enclosure, and the other end side of the shaft portion retains the guard electrode, and the one end side of the guard electrode side bellows retains the one end side of the shaft portion, and the other end side of the guard electrode side bellows is retained by the vacuum enclosure.

The guard electrode supporting unit has a shaft portion that extends from the guard electrode to the one end side of the vacuum chamber, the guard electrode side bellows are formed by outside bellows member and inside bellows member which extend in the both end directions of the vacuum chamber and are concentrically arranged between the guard electrode and the vacuum enclosure, the shaft portion extends in the both end directions of the vacuum chamber between the outside bellows member and the inside bellows member, and one end side of the shaft portion penetrates the vacuum enclosure and extends outside the vacuum enclosure, and the other end side of the shaft portion retains the guard electrode, and each one end side of the outside bellows member and the inside bellows member is retained by the vacuum enclosure, and each other end of the outside bellows member and the inside bellows member retains the other end side of the shaft portion.

The guard electrode has a tubular shape that extends in the both end directions of the vacuum chamber at an outer circumferential side of the emitter, and a target side of the guard electrode is moved by movement of the guard electrode supporting unit and contacts and separates from the electron generating portion of the emitter. Further, the guard electrode is provided, at the target side thereof, with a small diameter portion. Moreover, the guard electrode is provided, at the target side thereof, with an edge portion that extends in a crossing direction of the vacuum chamber and overlaps with a circumferential edge portion of the electron generating portion of the emitter in the both end directions of the vacuum chamber.

A grid electrode is provided between the emitter and the target in the vacuum chamber.

The electric field radiation device further comprises: a movable target supporting unit supporting the target movably in the both end directions of the vacuum chamber. And, the target supporting unit is configured to change a distance between the electron generating portion of the emitter and the target by movement of the target supporting unit. Further, the target supporting unit has target side bellows that can expand and contract in the both end directions of the vacuum chamber, and either one end side or the other end side of the target side bellows retains the target supporting unit and the other is retained by the vacuum enclosure, and the target side bellows form a part of the vacuum enclosure.

As one aspect of the regeneration processing method of the above electric field radiation device, a regeneration processing method comprises: applying voltage across the guard electrode in a state in which the electron generating portion of the emitter and the guard electrode are separate from each other by operation of the guard electrode supporting unit; and performing a regeneration process to at least the guard electrode in the vacuum chamber.

Further, As the regeneration processing method of the electric field radiation device having the target supporting unit, a regeneration processing method comprises: applying voltage across the guard electrode in a state in which the electron generating portion of the emitter and the guard electrode are separate from each other by operation of the guard electrode supporting unit and in which a distance between the electron generating portion of the emitter and the target is shortened more than that at a time of field emission by operation of the target supporting unit; and performing a regeneration process to at least the guard electrode in the vacuum chamber.

According to the present invention described above, it is possible to perform the regeneration process of the guard electrode etc. while suppressing the field emission of the emitter and contribute to an improvement in characteristics of the electric field radiation device.

EMBODIMENTS FOR CARRYING OUT THE INVENTION

Figure 1:
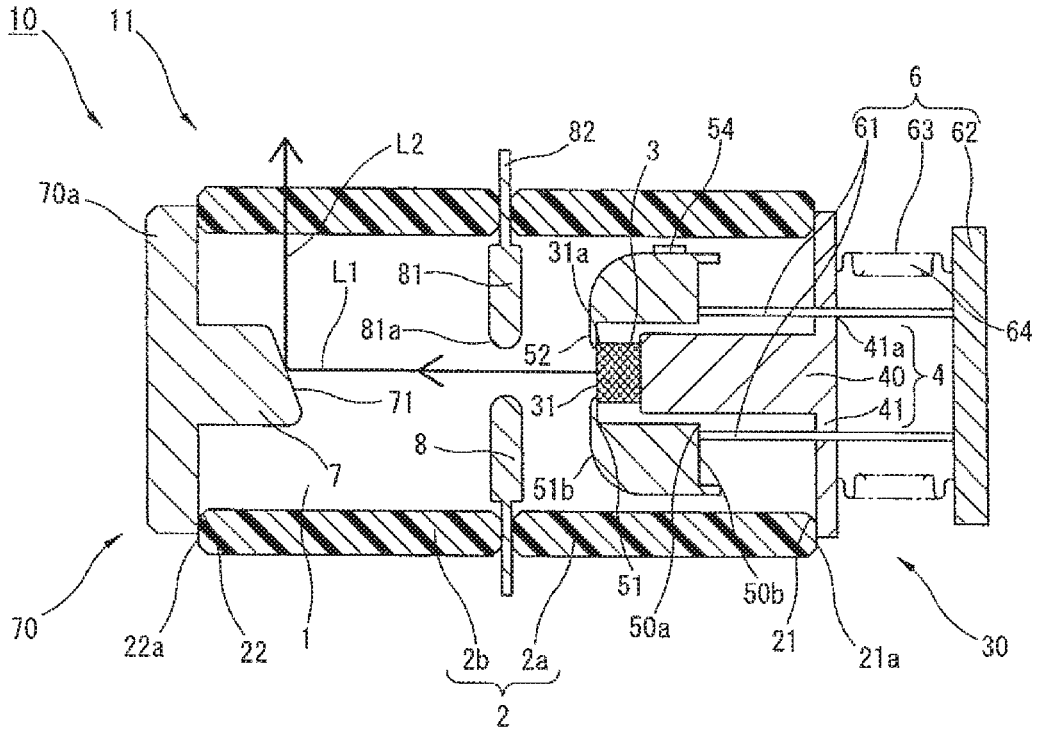
FIG. 1 is a schematic explanatory drawing showing an electric field radiation device according to an embodiment 1 of the present invention (a sectional view cut in both directions of a vacuum chamber 1 (in a state in which an emitter 3 and a guard electrode 5 contact each other)).

An electric field radiation device according to embodiments of the present invention is not an electric field radiation device merely having an emitter and a target which are positioned so as to face to each other and a guard electrode at an outer circumferential side of an electron generating portion of the emitter in a vacuum chamber formed by sealing both end sides of an insulator, but an electric field radiation device having a movable guard electrode supporting unit that supports the guard electrode movably in directions of both ends of the vacuum chamber (hereinafter, simply called both end directions) and configured to be able to change a distance between the electron generating portion of the emitter and the guard electrode by movement of the guard electrode supporting unit.

As conventional regeneration processing method of the guard electrode etc., other than the method of applying high voltage across the guard electrode etc. as mentioned above, a method of removing adsorbed gas by exposing guard electrode etc. in a vacuum atmosphere has been known. This method is a method in which, for instance, an electric field radiation device (hereinafter, called a conventional device) is formed with a large diameter exhaust pipe being provided at a vacuum enclosure, and by bringing the vacuum chamber into a high temperature vacuum state through the large diameter exhaust pipe, the adsorbed gas of the guard electrode etc. in the vacuum chamber is released, and subsequently, the vacuum chamber is returned to an atmospheric state and the emitter etc. are arranged in the vacuum chamber through the large diameter exhaust pipe, then by sealing the vacuum chamber, the vacuum chamber is brought into the vacuum state again.

However, it is difficult to maintain the high temperature vacuum state of the vacuum chamber in the vacuum enclosure provided with the large diameter exhaust pipe for a long time. Further, there is a risk that gas will be re-adsorbed to the guard electrode etc. before the vacuum chamber is brought into the vacuum state again. Therefore, it is impossible to regenerate (smooth) a coarse surface formed at the guard electrode etc. In addition, the vacuum enclosure increases in size due to the large diameter exhaust pipe, also man-hour of manufacturing may increase and product cost may increase.

On the other hand, the embodiments of the present invention have a configuration in which the distance between the electron generating portion and the guard electrode can be changed by operating the guard electrode supporting unit, and this configuration is a configuration that can perform the regeneration process of the guard electrode etc. without using the above-mentioned methods. To perform the regeneration process, for instance, as shown in after-mentioned FIG. 1, in a case where the guard electrode is located at a position at which the guard electrode contacts the electron generating portion of the emitter (or the guard electrode is positioned close to the electron generating portion of the emitter) and desired field emission from the emitter is possible (a position at which the dispersion of the electron beam emitted from the emitter is suppressed during the field emission; hereinafter, simply called an emitter position, as necessary), the guard electrode is moved toward a target side (in a direction in which a distance between the guard electrode and the target is shortened) by operating the guard electrode supporting unit, then as shown in after-mentioned FIG. 2, the guard electrode is held at a position (hereinafter, simply called a separate position, as necessary) at which the guard electrode is separate from the emitter (the electron generating portion).

Then, by applying voltage across the guard electrode etc. located at the separate position, the guard electrode etc. undergo the regeneration process, for instance, surfaces of the guard electrode etc. melt or dissolve and are smoothed out. With this, the withstand voltage performance can be obtained. Further, when the guard electrode is in the state of the separate position as described above, the field emission of the emitter is suppressed during the regeneration process, and thus no load is applied to the emitter.

Therefore, according to the regeneration process of the embodiments, even if the minute protrusion exists on the surfaces of the guard electrode etc., the surfaces can be smoothed. Further, in the case where gas component (e.g. the residual gas component in the vacuum enclosure) is adsorbed, the adsorbed gas is released. Moreover, in the case where the element causing the electron to be easily generated is contained in the guard electrode etc., by the above melt-smoothing, the element can be held or stored inside the guard electrode etc., and generation of the electrons, caused by the element, can be suppressed. Hence, the quantity of generation of the electron can be easily stabilized in the electric field radiation device.

After performing the regeneration process of the guard electrode etc. as described above, by operating the guard electrode supporting unit again, the guard electrode is moved to the emitter position from the separate position (moved in a direction in which a distance between the electron generating portion of the emitter and the guard electrode is shortened), then a state in which the field emission of the emitter is possible (e.g. as shown in FIG. 1, a state in which the electron generating portion of the emitter and the guard electrode contact each other or are positioned close to each other) is set. A desired function of the electric field radiation device (in the case of the X-ray apparatus, X-irradiation etc.) can therefore be obtained.

Here, in a case where the regeneration process of the guard electrode etc. located at the emitter position is performed, it is conceivable that voltage (hereinafter, simply called a regeneration voltage) applied across the guard electrode etc. will be set to, for instance, the same level of voltage as a rated voltage at a time of the field emission (that is, a rated voltage of a state in which the guard electrode is located at the emitter position and the field emission is possible), or to a magnitude of voltage of 1.2 times or more of the rated voltage with consideration given to a margin. Further, it is conceivable that since insulation performance of an outer peripheral side of the vacuum enclosure of the electric field radiation device is low as compared with an inside (the vacuum chamber) of the vacuum enclosure, by performing proper insulation process at the outer peripheral side of the vacuum enclosure by insulator such as mold, insulating oil and insulating gas, a desired withstand voltage performance is obtained (the flashover phenomenon is suppressed during the regeneration process) and safety is ensured. However, the above insulation process requires a complicated work or a large-scale facility, and it is difficult to remove or retrieve the insulator after performing the regeneration process, then these might affect productivity and quality of the electric field radiation device.

On the other hand, in the case, as shown in the embodiment, where the guard electrode is moved toward the target side and held at the separate position, a gap (e.g. a gap between the guard electrode and the target or a gap between the guard electrode and a grid electrode, hereinafter, simply called a gap) of the electrode across which the regeneration voltage is applied can be narrower than that at a time of the field emission. It is therefore possible to set the regeneration voltage to be lower than the rated voltage, and a desired withstand voltage can be obtained without performing the insulation process.

Hence, according to the embodiments, the above regeneration process can contribute to an improvement in characteristics of the electric field radiation device, and also contribute to improvement in productivity and safety of the electric field radiation device since work and facility for manufacturing the electric field radiation device can be reduced and the flashover phenomenon can be suppressed during the regeneration process.

The electric field radiation device of the embodiments can be variously modified by properly applying common general technical knowledge of each technical field as long as the electric field radiation device has the guard electrode supporting unit supporting the guard electrode movably in the both end directions and is configured to be able to change the distance between the electron generating portion of the emitter and the guard electrode as described above. Examples of the electric field radiation device will be explained below.

«Embodiment 1 of Electric Field Radiation Device»

Figure 2:
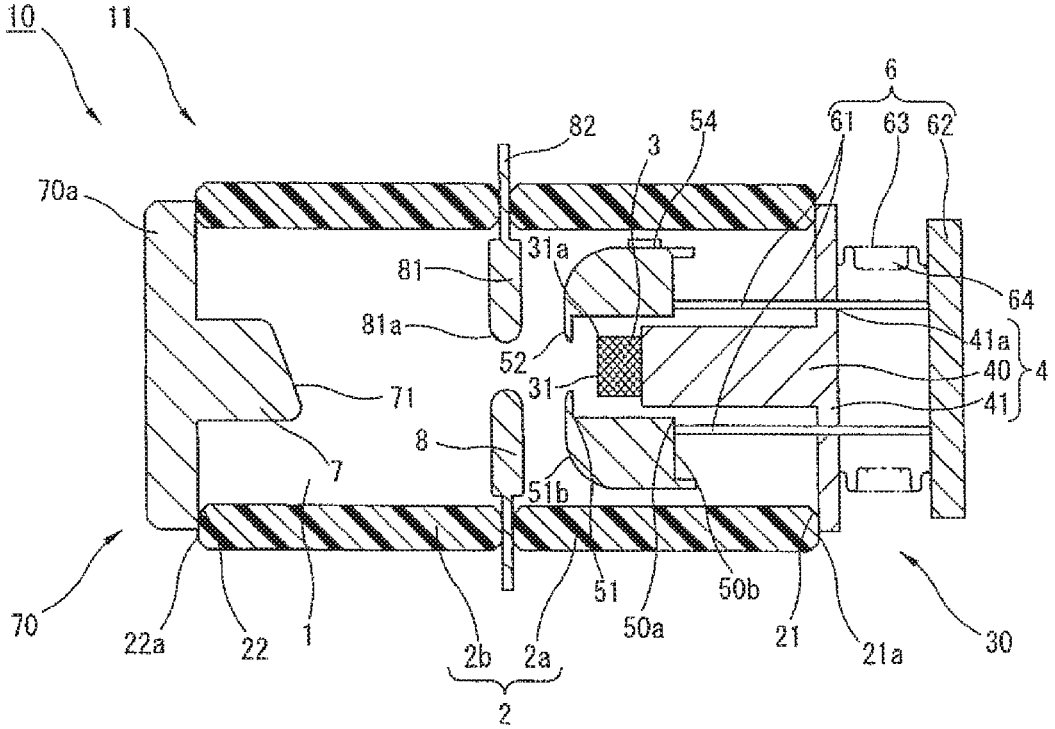
FIG. 2 is a schematic explanatory drawing showing the electric field radiation device according to the embodiment 1 of the present invention (a sectional view cut in both directions of the vacuum chamber 1 (in a state in which the emitter 3 and the guard electrode 5 separate from each other)).

A reference sign 10 in FIGS. 1 and 2 is an example of an X-ray apparatus to which the electric field radiation device of the present embodiment 1 is applied. In this X-ray apparatus 10, an opening 21 at one end side of a tubular insulator 2 and an opening 22 at the other end side are sealed with an emitter unit 30 and a target unit 70 respectively (e.g. by brazing), and a vacuum enclosure 11 having a vacuum chamber 1 at an inner wall side of the insulator 2 is defined. Between the emitter unit 30 (an after-mentioned emitter 3) and the target unit 70 (an after-mentioned target 7), a grid electrode 8 that extends in a crossing direction of the vacuum chamber 1 is provided.

The insulator 2 is formed of insulation material such as ceramic. As the insulator 2, various shapes or forms can be employed as long as they can isolate the emitter unit 30 (the emitter 3) and the target unit 70 (the target 7) from each other and form the vacuum chamber 1 inside them. For instance, as shown in the drawings, it is a configuration in which the grid electrode 8 (e.g. a lead terminal 82) is interposed between concentrically-arranged two tubular insulation members 2*a* and 2*b* and the both insulation members 2*a* and 2*b* are fixed together by brazing etc.

The emitter unit 30 has the emitter 3 having, at a portion facing to the target unit 70 (the target 7), an electron generating portion 31, a guard electrode 5 provided at an outer circumferential side of the electron generating portion 31 of the emitter 3 and a movable guard electrode supporting unit 6 supporting the guard electrode 5 movably in the both end directions.

As the emitter 3, various shapes or forms can be employed as long as they have the electron generating portion 31 as described above and electrons are generated from the electron generating portion 31 by application of voltage and also as shown in the drawings they can emit an electron beam L1 (as a radiator or an emitter). For instance, it is made of material of carbon etc. (carbon nanotube etc.), and as shown in the drawings, a solid emitter or a thin-film emitter formed by evaporation is used as the emitter 3. As the electron generating portion 31, it is preferable to shape a surface, facing to the target unit 70 (the target 7), of the electron generating portion 31 into a concave shape (a curved shape) in order for the electron beam L1 to easily converge.

Further, as a configuration to support the emitter 3 in the vacuum enclosure 11, various shapes or forms can be employed. For instance, it is a configuration in which the emitter 3 is supported by an emitter supporting unit 4 provided so as not to interfere with movement (described later) of the guard electrode supporting unit 6 and movement (described later) of the guard electrode 5. As an example of the emitter supporting unit 4, it is a configuration having a columnar lead portion 40 that extends in the both end directions at an inner side of the guard electrode 5, a flange portion 41 that is formed at one end side (the opening 21 side) of the lead portion 40 and extends in the crossing direction of the vacuum chamber 1 and at least one guiding hole (guiding holes provided for after-mentioned shaft portions 61 and penetrating the flange portion 41 in the both end directions) 41*a* formed at an outer circumferential side of the lead portion 40 on the flange portion 41. According to the emitter supporting unit 4 having such a configuration, the emitter supporting unit 4 is supported on an end surface 21*a* of the opening 21 of the insulator 2 through the flange portion 41, and the emitter 3 is supported at the other end side (the opening 22 side) of the lead portion 40 (for instance, an opposite side to the electron generating portion 31 of the emitter 3 is fixed to the other end side of the lead portion 40 by crimping, swaging or welding and so on).

As the guard electrode 5, various shapes or forms can be employed as long as they are provided at the outer circumferential side of the electron generating portion 31 of the emitter 3 as described above and move by and according to the movement of the guard electrode supporting unit 6 then contact and separate from the electron generating portion 31 of the emitter 3 and can suppress the dispersion of the electron beam L1 emitted from the emitter 3 in a contacting state with the emitter 3 (e.g. in the state shown in FIG. 1).

As an example of the guard electrode 5, the guard electrode 5 is made of material of stainless (SUS material etc.), and has a tubular shape that extends in the both end directions of the vacuum chamber 1 at an outer circumferential side of the emitter 3. And, an edge surface 50*b* at one end side opening 50*a* in the both end directions of the guard electrode 5 is supported by the guard electrode supporting unit 6, and an opening 51 side (e.g. an after-mentioned edge portion 52) that is the other end side (i.e. the target 7 side) in the both end directions contacts and separates from the emitter 3.

Figure 3:
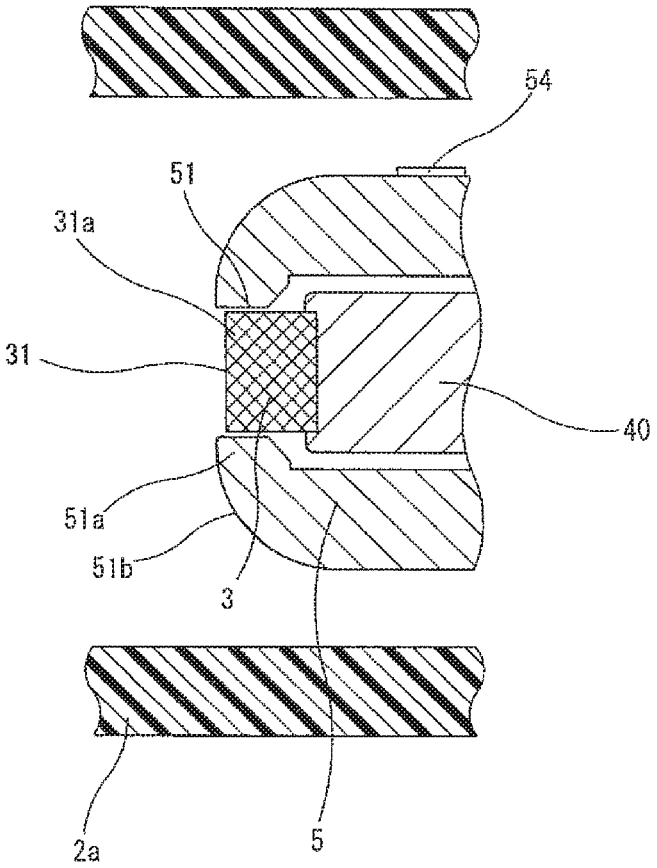
FIG. 3 is a schematic explanatory drawing showing an example of the guard electrode 5 of the embodiment 1 (an enlarged view of a part of FIG. 1, where the guard electrode 5 has a small diameter portion 51*a* instead of an edge portion 52).

This configuration of the guard electrode 5 to contact and separate from the emitter 3 is not especially limited. For instance, as shown in FIG. 3, a configuration in which a small diameter portion 51*a* is formed at the other end side in the both end directions of the guard electrode 5 is conceivable. However, the configuration as shown in FIGS. 1 and 2, in which the edge portion 52 that extends in the crossing direction of the vacuum chamber 1 (at the target 7 side with respect to the emitter 3) and crosses or overlaps with a circumferential edge portion 31*a* of the electron generating portion 31 of the emitter 3 in the both end directions of the vacuum chamber 1 is formed, is raised. Further, both of the small diameter portion 51*a* and the edge portion 52 could be formed.

Here, in the case of the guard electrode 5 shown in the drawings, although a getter 54 is fixed to an outer circumferential side of the guard electrode 5 by welding, a fixing position and material of the getter 54 are not especially limited. Further, it is possible to employ such a shape as to suppress a local electric field concentration which could occur at the electron generating portion 31 (especially, at the circumferential edge portion 31*a*) and/or suppress the flashover occurring from the electron generating portion 31 to other portions, by enlarging an apparent radius of curvature of the circumferential edge portion 31*a* of the electron generating portion 31 of the emitter 3. For instance, as shown in the drawings, the guard electrode 5 has a shape having a curved surface portion 51*b* at the other end side in the both end directions.

As the guard electrode supporting unit 6, various shapes or forms can be employed as long as they can support the guard electrode 5 movably in the both end directions as described above. As an example, as shown in the drawings, the guard electrode supporting unit 6 has a plurality of columnar shaft portions 61 that extend in the both end directions (from guard electrode 5 to the one end side) and support the guard electrode 5, an operating plate 62 that extends in the crossing direction of the vacuum chamber 1 and retains each shaft portion 61 and guard electrode side bellows 63 (hereinafter, simply called bellows 63, as necessary) that can expand and contract in the both end directions and are retained by the flange portion 41 (i.e. by the vacuum enclosure 11) while maintaining air tightness of the vacuum chamber 1 and retain the plate 62 (i.e. retain the guard electrode supporting unit 6).

The shaft portions 61 movably penetrate the guiding holes 41*a* of the flange portion 41 so as to be arranged at predetermined intervals in a circumferential direction (so as to be arranged at positions corresponding to the guiding holes 41*a*) at the outer circumferential side of the lead portion 40. And, one end side of each shaft portion 61 is retained by the plate 62, and the other end side of each shaft portion 61 supports the edge surface 50*b* of the guard electrode 5 (for instance, the other end side of each shaft portion 61 and the edge surface 50*b* of the guard electrode 5 are fixed by crimping, swaging or welding and so on). However, the arrangement of the shaft portions 61 and retaining and supporting manners are not limited to the above configuration.

Further, the bellows 63 have a bellow tubular wall 64 that extends in the both end directions so as to surround or cover an outer circumferential side at a tubular one end side of each shaft portion 61 penetrating the guiding holes 41*a* of the flange portion 41. One end side of the bellows 63 is fixed to the plate 62 by brazing etc., and the other end side of the bellows 63 is fixed to an outer circumferential side, with respect to the shaft portions 61 (an outer circumferential side with respect to a group of the guiding holes 41*a*), of the flange portion 41 by brazing etc. Then, the bellows 63 define the vacuum chamber 1 and an atmospheric side (an outer peripheral side of the vacuum enclosure 11). However, fixing manner etc. of the bellows 63 are not limited to the above configuration.

By the expansion and contraction of the bellows 63, the shaft portions 61 of the guard electrode supporting unit 6 configured as above move in the both end directions by being guided by the guiding holes 41*a*, and consequently, the guard electrode 5 also moves in the both end directions. In the case where the guard electrode 5 has the small diameter portion 51*a* or the edge portion 52, the guard electrode 5 moves in the both end directions at the outer circumferential side of the emitter 3 by the movement of the guard electrode supporting unit 6, and the small diameter portion 51*a* or the edge portion 52 contacts and separates from the electron generating portion 31 of the emitter 3.

In the case of the configuration in which the guard electrode 5 has the edge portion 52, when the guard electrode 5 contacts the emitter 3, the circumferential edge portion 31*a* of the electron generating portion 31 is covered with and protected by the edge portion 52. Further, movement of the guard electrode 5 toward the one end side in the both end directions is restrained or limited by the edge portion 52. That is, positioning of the guard electrode 5 with respect to a position of the emitter 3 is facilitated.

The guard electrode supporting unit 6 can be formed of various material, and material is not especially limited. For instance, the guard electrode supporting unit 6 could be formed of conductive metal material such as stainless (SUS material etc.) and copper. The bellows 63 could be molded by working of metal material such as metal sheet or metal plate.

Next, the target unit 70 has the target 7 facing to the electron generating portion 31 of the emitter 3 and a flange portion 70*a* supported by an end surface 22*a* of the opening 22 of the insulator 2.

As the target 7, various shapes or forms can be employed as long as the electron beam L1 emitted from the electron generating portion 31 of the emitter 3 collides and as shown in the drawings an X-ray L2 can be emitted. In the drawings, the target 7 has, at a portion facing to the electron generating portion 31 of the emitter 3, an inclined surface 71 that extends in an intersecting direction that inclines at a predetermined angle with respect to the electron beam L1. By the fact that the electron beam L1 collides with this inclined surface 71, the X-ray L2 is emitted in a direction (e.g. in the crossing direction of the vacuum chamber 1 as shown in the drawings) that is bent from an irradiation direction of the electron beam L1.

As the grid electrode 8, various shapes or forms can be employed as long as they are interposed between the emitter 3 and the target 7 as described above and they can properly control the electron beam L1 that passes thorough them. For instance, as shown in the drawings, the grid electrode 8 has an electrode portion (e.g. a mesh electrode portion) 81 extending in the crossing direction of the vacuum chamber 1 and having a passing hole 81*a* thorough which the electron beam L1 passes and the lead terminal 82 penetrating the insulator 2 (in the crossing direction of the vacuum chamber 1).

According to the X-ray apparatus 10 configured as described above, by properly operating the guard electrode supporting unit 6 (through the plate 62), it is possible to change the distance between the electron generating portion 31 of the emitter 3 and the guard electrode 5. For instance, as shown in FIG. 2, in a state in which the guard electrode 5 is moved from the emitter position to the separate position and the field emission of the emitter 3 is suppressed, a desired regeneration process for the guard electrode 5, the target 7, the grid electrode 8 etc. can be performed. Further, as compared with the above-mentioned conventional device provided with the large diameter exhaust pipe, size reduction can be readily achieved, and also reduction in man-hour of manufacturing and reduction in product cost can be realized.

«An Example of Regeneration Process for Guard Electrode Etc. of X-Ray Apparatus 10»

When performing the regeneration process for the guard electrode 5 etc. of the X-ray apparatus 10, first, by operating the guard electrode supporting unit 6, the guard electrode 5 is moved to the opening 22 side (to the separate position) as shown in FIG. 2, and the state in which the field emission of the electron generating portion 31 is suppressed is set. In this state, both of the electron generating portion 31 of the emitter 3 and the edge portion 52 (in the case of FIG. 3, the small diameter portion 51*a*) of the guard electrode 5 are separate from each other (the edge portion 52 (or the small diameter portion 51*a*) is moved so that the emitter 3 is a discharge electric field or less). By properly applying a predetermined regeneration voltage between the guard electrode 5 and the grid electrode 8 (the lead terminal 82) and/or between the target 7 and the grid electrode 8 in this state shown in FIG. 2, discharge is repeated at the guard electrode 5 etc., then the guard electrode 5 etc. undergo the regeneration process (the surface of the guard electrode 5 melts or dissolves and is smoothed out). Here, in this state, since the gap between the guard electrode 5 and the grid electrode 8 is narrower than that at the time of the field emission, the regeneration voltage applied between the guard electrode 5 and the grid electrode 8 can be set to be lower than the rated voltage.

After performing the regeneration process, by operating the guard electrode supporting unit 6 again, the guard electrode 5 is moved to the opening 21 side (to the emitter position) as shown in FIG. 1, and the state in which the field emission of the electron generating portion 31 is possible is set. In this state, both of the electron generating portion 31 of the emitter 3 and the edge portion 52 of the guard electrode 5 contact each other (for instance, by vacuum pressure in the vacuum chamber 1) as shown in FIG. 1. By applying a predetermined voltage between the emitter 3 and the target 7 with the electron generating portion 31 of the emitter 3 and the guard electrode 5 being at the same potential in this state shown in FIG. 1, electrons are generated from the electron generating portion 31 of the emitter 3 and the electron beam L1 is emitted, and the electron beam L1 collides with the target 7, then the X-ray L2 is emitted from the target 7.

By the regeneration process as described above, it is possible to suppress the flashover phenomenon (generation of the electrons) from the guard electrode 5 etc. in the X-ray apparatus 10, thereby stabilizing the quantity of generation of the electron of the X-ray apparatus 10. Further, the electron beam L1 can become a converging electron beam, and this easily brings the X-ray L2 to a focus, then high radioscopy resolution can be obtained.

«Embodiment 2 of Electric Field Radiation Device»

Figure 4:
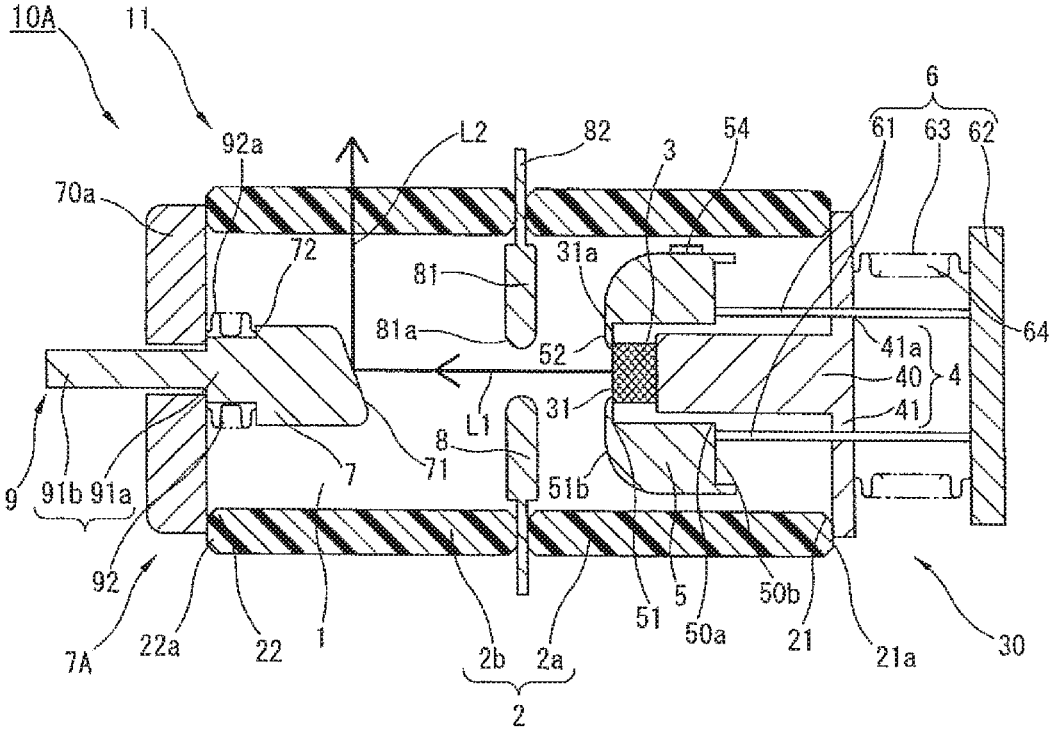
FIG. 4 is a schematic explanatory drawing showing an electric field radiation device according to an embodiment 2 of the present invention (a sectional view cut in both directions of the vacuum chamber 1 (in a state in which the emitter 3 and the guard electrode 5 contact each other)).
Figure 5:
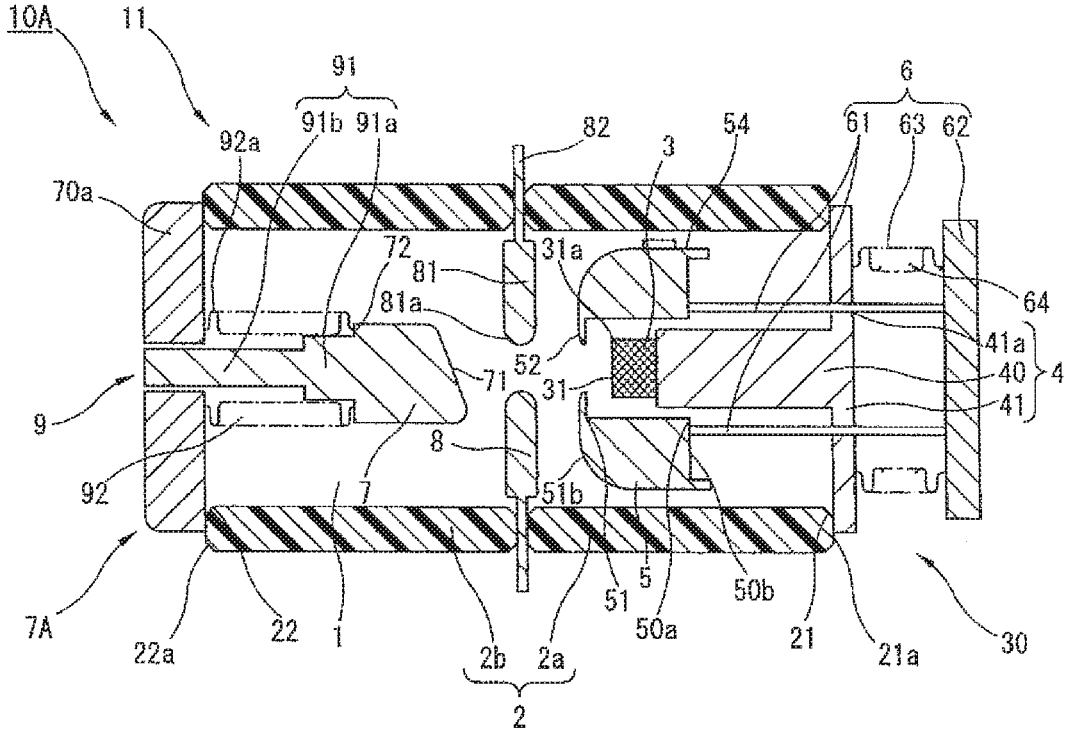
FIG. 5 is a schematic explanatory drawing showing the electric field radiation device according to the embodiment 2 of the present invention (a sectional view cut in both directions of the vacuum chamber 1 (in a state in which the emitter 3 and the guard electrode 5 separate from each other)).

The X-ray apparatus 10 shown in FIGS. 1 and 2 has the guard electrode supporting unit 6. However, it is possible to employ a configuration, like an X-ray apparatus 10A as shown in FIGS. 4 and 5, in which the guard electrode supporting unit 6 and a target supporting unit 9 that supports the target 7 movably in the both end directions are provided. This configuration also has the same effect and working as those of the X-ray apparatus 10. Here, in FIGS. 4 and 5, the same element or component as that of FIGS. 1 to 3 is denoted by the same reference sign, and its explanation will be omitted below.

A target unit 7A of the X-ray apparatus 10A shown in FIGS. 4 and 5 has the target 7, the flange portion 70*a* and the movable target supporting unit 9 supporting the target 7 movably in the both end directions. As the target supporting unit 9, various shapes or forms can be employed as long as they can support target 7 movably in the both end directions as described above. As an example, as shown in the drawings, the target supporting unit 9 has a shaft portion 91 that extends from a side opposite to the inclined surface 71 of the target 7 and movably penetrates a guiding hole (a guiding hole that penetrates the flange portion 70*a* in the both end directions) 70*b* formed at the flange portion 70*a* and target side bellows 92 (hereinafter, simply called bellows 92, as necessary) that can expand and contract in the both end directions and are retained by the flange portion 70*a* (i.e. by the vacuum enclosure 11) while maintaining air tightness of the vacuum chamber 1 and retain the target 7 (a circumferential edge portion 72 located at the opposite side to the inclined surface 71 of the target 7, in the drawings) (i.e. retain the target supporting unit 9).

The shaft portion 91 is provided, at one end side thereof, with a wide diameter portion 91*a* whose diameter is smaller than that of the target 7 and is greater than that of the guiding hole 70*b*. The shaft portion 91 is also provided, at the other end side thereof, with a reduced diameter portion 91*b* whose diameter is smaller than that of the guiding hole 70*b* and which movably penetrates the guiding hole 70*b*. With this, the shaft portion 91 is structured so that only the reduced diameter portion 91*b* can penetrate the guiding hole 70*b*.

Further, movement of the shaft portion 91 toward the other end side in the both end directions is restrained or limited by the wide diameter portion 91*a*. For instance, by previously setting this restraining position by the wide diameter portion 91*a* (a position at which the wide diameter portion 91*a* contacts an opening edge surface of the flange portion 70*a*) to a position of the target 7 which is suitable for the field emission, even after moving the target 7 by the target supporting unit 9, positioning of the target 7 at the time of the field emission is facilitated. Moreover, the shaft portion 91 may be configured so that movement of the shaft portion 91 toward the one end side in the both end directions is restrained or limited. For instance, a top end of the other end side of the shaft portion 91 is shaped into a wide diameter shape, or a stopper is provided at the other end side of the shaft portion 91.

The bellows 92 have a bellow tubular wall 92*a* that extends in the both end directions so as to surround or cover an outer circumferential side of the shaft portion 91. One end side of the bellows 92 is fixed to the circumferential edge portion 72 located at the opposite side to the inclined surface 71 of the target 7 by brazing etc., and the other end side of the bellows 92 is fixed to an outer circumferential side, with respect to the shaft portion 91 (an outer circumferential side with respect to the guiding hole 70*b*), of the flange portion 70*a* by brazing etc. Then, the bellows 92 define the vacuum chamber 1 and the atmospheric side (the outer peripheral side of the vacuum enclosure 11). However, fixing manner etc. of the bellows 92 are not limited to the above configuration.

By the expansion and contraction of the bellows 92, the shaft portion 91 of the target supporting unit 9 configured as above move in the both end directions by being guided by the guiding hole 70*b*, and consequently, the target 7 also moves in the both end directions.

According to the X-ray apparatus 10A configured as described above, in the same manner as the X-ray apparatus 10, it is possible to change the distance between the electron generating portion 31 of the emitter 3 and the guard electrode 5, and further, by properly operating the target supporting unit 9 (through the other end side of the shaft portion 91), it is also possible to change a distance between the electron generating portion 31 of the emitter 3 and the target 7. That is, in the same manner as the X-ray apparatus 10, in a state in which the field emission of the emitter 3 is suppressed, a desired regeneration process for the guard electrode 5, the target 7, the grid electrode 8 etc. can be performed. Further, as compared with the above-mentioned conventional device provided with the large diameter exhaust pipe, size reduction can be readily achieved, and also reduction in man-hour of manufacturing and reduction in product cost can be realized.

«An Example of Regeneration Process for Guard Electrode Etc. of X-Ray Apparatus 10A»

When performing the regeneration process for the guard electrode 5 of the X-ray apparatus 10, first, by operating the guard electrode supporting unit 6, the guard electrode 5 is moved to the opening 22 side (to the separate position) as shown in FIG. 5, and the state in which the field emission of the electron generating portion 31 is suppressed is set. Further, by operating the target supporting unit 9, as shown in FIG. 5, the target 7 is moved to the opening 21 side (to a position at which the target 7 is separate from the flange portion 70*a*). In this state, in the same manner as the X-ray apparatus 10 shown in FIG. 2, both of the electron generating portion 31 of the emitter 3 and the edge portion 52 (in the case of FIG. 3, the small diameter portion 51*a*) of the guard electrode 5 are separate from each other (the edge portion 52 (or the small diameter portion 51*a*) is moved so that the emitter 3 is a discharge electric field or less).

By properly applying a predetermined voltage between the guard electrode 5 and the grid electrode 8 and/or between the target 7 and the grid electrode 8 in this state shown in FIG. 5, discharge is repeated at the guard electrode 5 etc., then the guard electrode 5 etc. undergo the regeneration process. Here, in this state, since a gap between the target 7 and the grid electrode 8 is narrower than that at the time of the field emission, the regeneration voltage applied between the target 7 and the grid electrode 8 can be set to be lower than the rated voltage (for instance, the regeneration voltage applied between the target 7 and the grid electrode 8 can be set to be lower than that of the case of FIG. 2).

After performing the regeneration process, by operating the guard electrode supporting unit 6 again, the guard electrode 5 is moved to the opening 21 side (to the emitter position) as shown in FIG. 4, and the state in which the field emission of the electron generating portion 31 is possible is set. In this state, both of the electron generating portion 31 of the emitter 3 and the edge portion 52 of the guard electrode 5 contact each other (for instance, by vacuum pressure in the vacuum chamber 1) as shown in FIG. 4. Further, by operating the target supporting unit 9, the target 7 is moved to the position suitable for the field emission.

By applying a predetermined voltage between the emitter 3 and the target 7 with the electron generating portion 31 of the emitter 3 and the guard electrode 5 being at the same potential in this state shown in FIG. 4, electrons are generated from the electron generating portion 31 of the emitter 3 and the electron beam L1 is emitted, and the electron beam L1 collides with the target 7, then the X-ray L2 is emitted from the target 7.

Hence, by the regeneration process as described above, it is also possible to suppress the flashover phenomenon (generation of the electrons) from the guard electrode 5 etc. in the X-ray apparatus 10A, thereby stabilizing the quantity of generation of the electron of the X-ray apparatus 10A. Further, the electron beam L1 can become a converging electron beam, and this easily brings the X-ray L2 to a focus, then high radioscopy resolution can be obtained.

Although the embodiments of the present invention have been explained in detail, the present invention can be modified within technical ideas of the present invention. Such modifications belong to scope of claims.

For instance, in a case where heat is generated due to collision of the electron beam with the target, the electric field radiation device of the present invention could be configured to cool the electric field radiation device using a cooling function. As the cooling function, various ways such as air cooling, water cooling and oil cooling are used. In the case of the cooling function using the oil cooling, for instance, the electric field radiation device is immersed or submerged in cooling oil in a certain case. Further, a degassing or deaerating operation (using a vacuum pump) could be properly carried out in the submerged state.

As a method of maintaining air tightness (high vacuum) of the vacuum chamber of the vacuum enclosure, each element or component (such as the insulator, the emitter unit, the target unit etc.) that forms the vacuum enclosure could be integrally brazed. However, as long as air tightness (high vacuum) of the vacuum chamber of the vacuum enclosure can be maintained, various ways can be used.

Although the vacuum pressure is exerted to the guard electrode supporting unit and the target supporting unit in the vacuum chamber, various shapes or forms can be employed as long as they can support the emitter movably in the both end directions of the vacuum chamber by properly operating them.

For instance, a configuration, in which an operator can feel a click when the guard electrode and the target are moved to the respective predetermined positions (the guard electrode is moved to the emitter position or the separate position, and the target is moved to the position suitable for the field emission) by operation of the guard electrode supporting unit and the target supporting unit, could be used. With this configuration, it is possible to readily and quickly get the predetermined positions when operating the guard electrode supporting unit and the target supporting unit. This contributes to, for instance, improvement in operability of guard electrode supporting unit and the target supporting unit.

Further, the guard electrode side bellows 63 are not limited to the configuration as shown in FIGS. 1 and 2. A configuration (forming a part of the vacuum enclosure) that can maintain the air tightness of the vacuum chamber so as not to interfere with movement of the guard electrode supporting unit could be employed. That is, as long as the guard electrode side bellows can expand and contract in the both end directions of the vacuum chamber and either one end side or the other end side of the bellows retains the guard electrode supporting unit and the other is retained by the vacuum enclosure and also the guard electrode side bellows form a part of the vacuum enclosure, various shapes or forms can be employed.

Figure 6:
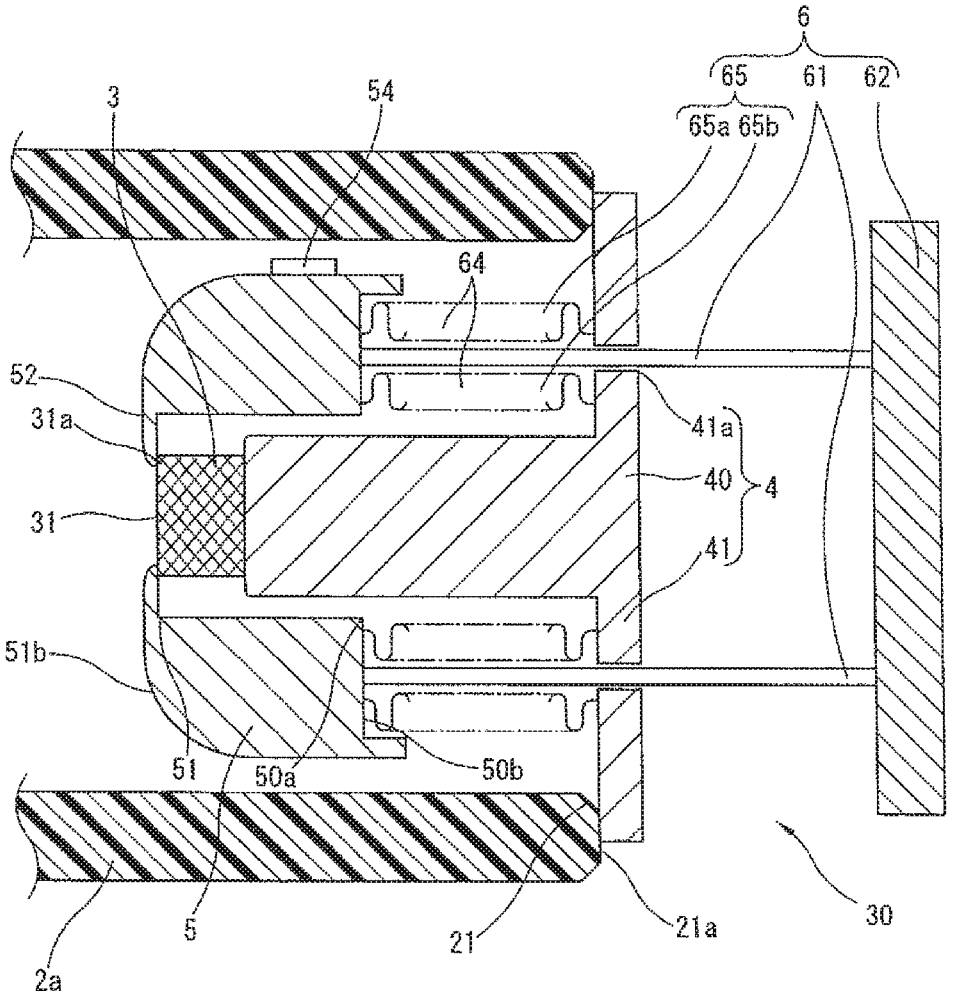
FIG. 6 is a schematic explanatory drawing showing one of modified examples of bellows of the embodiment (which corresponds to local sectional views of FIGS. 1 and 2.

Although the bellows 63 located outside the vacuum enclosure 11 are employed in the configuration shown in FIGS. 1 and 2, for instance, as shown in FIG. 6, guard electrode side bellows (bellows having outside bellows member 65*a* and inside bellows member 65*b*, described later) 65 located inside the vacuum enclosure 11 could be employed. This configuration can also obtain the same effect and working as those of configuration shown in FIGS. 1 and 2.

The guard electrode side bellows 65 shown in FIG. 6 have the outside bellows member 65*a* and the inside bellows member 65*b* which extend in the both end directions and are concentrically arranged between the guard electrode 5 and the vacuum enclosure 11. In FIG. 6, the shaft portions 61 extend in the both end directions between the outside bellows member 65*a* and the inside bellows member 65*b*. And, one end side of each shaft portion 61 movably penetrates the guiding hole 41*a* of the flange portion 41 (with the one end side extending outside the vacuum enclosure 11). Further, each one end side of the outside bellows member 65*a* and the inside bellows member 65*b* is retained by the vacuum enclosure 11 through the flange portion 41. And, each other end of the outside bellows member 65*a* and the inside bellows member 65*b* retains the other end side of each shaft portion (retains the guard electrode supporting unit 6) through the edge surface 50*b* of the guard electrode 5.

In the same manner as the guard electrode side bellows 63, also the target side bellows 92 are not limited to the configuration as shown in FIGS. 4 and 5. A configuration (forming a part of the vacuum enclosure) that can maintain the air tightness of the vacuum chamber so as not to interfere with movement of the target supporting unit could be employed. That is, as long as the target side bellows can expand and contract in the both end directions of the vacuum chamber and either one end side or the other end side of the bellows retains the target supporting unit and the other is retained by the vacuum enclosure and also the target side bellows form a part of the vacuum enclosure, various shapes or forms can be employed. This configuration (not shown) can also obtain the same effect and working as those of configuration shown in FIGS. 1 and 2.

Further, when employing the configuration, like the present invention, in which the guard electrode supporting unit and the target supporting unit are provided, by applying voltage between the emitter and target without through the bellows and allowing the field emission of the emitter, loss of the voltage application is suppressed.

Moreover, a fixing unit that properly fixes the guard electrode and the target at the respective predetermined positions could be employed. With this configuration, even if an unintentional external force (e.g. in the case of the configuration having the cooling function using the oil cooling, a suction force of the vacuum pump which may act on the supporting units upon deaerating operation of the cooling oil) acts on the guard electrode and the target or the guard electrode supporting unit 6 and the target supporting unit 9, it is possible to prevent the guard electrode and the target from shifting from the respective predetermined positions. Therefore, the field emission in the electric field radiation device and the regeneration process for the guard electrode etc. can be properly realized. This fixing manner is not especially limited, but various shapes or forms can be employed. When explaining the fixing manner with the X-ray apparatuses 10 and 10A taken as an example, a stopper such as screw that can suppress the shift of the guard electrode supporting unit 6 and the target supporting unit 9 in the both end directions could be employed.

The invention claimed is:

1. An electric field radiation device comprising:

a vacuum enclosure formed by sealing both end sides of a tubular insulator and having a vacuum chamber at an inner wall side of the insulator;

an emitter positioned at one end side of the vacuum chamber and having an electron generating portion that faces to the other end side of the vacuum chamber;

a guard electrode provided at an outer circumferential side of the electron generating portion, of the emitter;

a target positioned at the other end side of the vacuum chamber and facing to the electron generating portion of the emitter; and a movable guard electrode supporting unit supporting the guard electrode movably in both end directions of the vacuum chamber, and wherein the guard electrode supporting unit is configured to change a distance between the electron generating portion of the emitter and the guard electrode by movement of the guard electrode supporting unit, the guard electrode has a tubular shape that extends in the both end directions of the vacuum chamber at an outer circumferential side of the emitter, and a target side of the guard electrode is moved by movement of the guard electrode supporting unit and contacts and separates from the electron generating portion of the emitter.

2. The electric field radiation device as claimed in claim 1, wherein:

the guard electrode supporting unit has guard electrode side bellows that can expand and contract in the both end directions of the vacuum chamber, and either one end side or the other end side of the guard electrode side bellows retains the guard electrode supporting unit and the other is retained by the vacuum enclosure, and the guard electrode side bellows form a part of the vacuum enclosure.

3. The electric field radiation device as claimed in claim 2, wherein:

the guard electrode supporting unit has a shaft portion that extends from the guard electrode to the one end side of the vacuum chamber, one end side of the shaft portion penetrates the vacuum enclosure and extends outside the vacuum enclosure, and the other end side of the shaft portion retains the guard electrode, and the one end side of the guard electrode side bellows retains the one end side of the shaft portion, and the other end side of the guard electrode side bellows is retained by the vacuum enclosure.

4. The electric field radiation device as claimed in claim 2, wherein:

the guard electrode supporting unit has a shaft portion that extends from the guard electrode to the one end side of the vacuum chamber, the guard electrode side bellows are formed by outside bellows member and inside bellows member which extend in the both end directions of the vacuum chamber and are concentrically arranged between the guard electrode and the vacuum enclosure, the shaft portion extends in the both end directions of the vacuum chamber between the outside bellows member and the inside bellows member, and one end side of the shaft portion penetrates the vacuum enclosure and extends outside the vacuum enclosure, and the other end side of the shaft portion retains the guard electrode, and each one end side of the outside bellows member and the inside bellows member is retained by the vacuum enclosure, and each other end of the outside bellows member and the inside bellows member retains the other end side of the shaft portion.

5. The electric field radiation device as claimed in claim 1, wherein:

the guard electrode is provided, at the target side thereof, with a small diameter portion.

6. The electric field radiation device as claimed in claim 1, wherein:

the guard electrode is provided, at the target side thereof, with an edge portion that extends in a crossing direction of the vacuum chamber and overlaps with a circumferential edge portion of the electron generating portion of the emitter in the both end directions of the vacuum chamber.

7. The electric field radiation device as claimed in claim 1, wherein:

a grid electrode is provided between the emitter and the target in the vacuum chamber.

8. The electric field radiation device as claimed in claim 1, further comprising:

a movable target supporting unit supporting the target movably in the both end directions of the vacuum chamber, and wherein the target supporting unit is configured to change a distance between the electron generating portion of the emitter and the target by movement of the target supporting unit.

9. The electric field radiation device as claimed in claim 8, wherein:

the target supporting unit has target side bellows that can expand and contract in the both end directions of the vacuum chamber, and either one end side or the other end side of the target side bellows retains the target supporting unit and the other is retained by the vacuum enclosure, and the target side bellows form a part of the vacuum enclosure.

10. A regeneration processing method of the electric field radiation device as claimed in claim 1, comprising:

applying voltage across the guard electrode in a state in which the electron generating portion of the emitter and the guard electrode are separate from each other by operation of the guard electrode supporting unit; and performing a regeneration process to at least the guard electrode in the vacuum chamber.

11. A regeneration processing method of the electric field radiation device as claimed in claim 8, comprising:

applying voltage across the guard electrode in a state in which the electron generating portion of the emitter and the guard electrode are separate from each other by operation of the guard electrode supporting unit and in which a distance between the electron generating portion of the emitter and the target is shortened more than that at a time of field emission by operation of the target supporting unit; and performing a regeneration process to at least the guard electrode in the vacuum chamber.

* * * * *